US010518431B2

(12) United States Patent
Klockow et al.

(10) Patent No.: US 10,518,431 B2
(45) Date of Patent: Dec. 31, 2019

(54) SIZE-REDUCTION MACHINES, FEED UNITS THEREFOR, AND METHODS OF USE

(71) Applicant: Urschel Laboratories, Inc., Chesterton, IN (US)

(72) Inventors: Scott Alan Klockow, Kouts, IN (US); Nicholas Alan Underwood, Valparaiso, IN (US); Rudiger Heinrich Stenger, Bernau am Chiensee (DE)

(73) Assignee: Urschel Laboratories, Inc., Chesterton, IN (US)

( * ) Notice: Subject to any disclaimer, the term of this patent is extended or adjusted under 35 U.S.C. 154(b) by 81 days.

(21) Appl. No.: 15/789,034

(22) Filed: Oct. 20, 2017

(65) Prior Publication Data

US 2018/0111283 A1 Apr. 26, 2018

Related U.S. Application Data

(60) Provisional application No. 62/411,037, filed on Oct. 21, 2016.

(51) Int. Cl.

| | |
|---|---|
| ***B26D 7/06*** | (2006.01) |
| ***B26D 7/26*** | (2006.01) |
| ***B26D 1/36*** | (2006.01) |

(52) U.S. Cl.

CPC ..... *B26D 7/0641* (2013.01); *B26D 1/36* (2013.01); *B26D 7/0625* (2013.01); (Continued)

(58) Field of Classification Search

CPC ..... B26D 7/0641; B26D 7/0683; B26D 1/36; B26D 2210/02; B26D 7/0691; B26D 7/2614; B26D 7/0625; B26D 7/1854; B26D 1/38; B26D 3/18; B26D 1/0006; B26D 3/26; B26D 2001/0033; B26D 1/02; B26D 3/22; B26D 7/06; A22C 17/0033; Y10T 83/9377; Y10T 83/04; Y10T 83/0538; Y10T 83/2092; Y10T 83/6492; Y10T 83/73

USPC ... 83/13, 665, 42, 23, 37, 39, 403, 408, 110, 83/356.3, 663, 675, 402, 418, 452, 932, 83/446, 447, 109, 98; 99/538, 568, 539, (Continued)

(56) References Cited

U.S. PATENT DOCUMENTS

| | | | | |
|---|---|---|---|---|
| 3,521,688 | A | 7/1970 | Urschel et al. | |
| 3,968,938 | A * | 7/1976 | Ruhl | B02C 18/06 241/101.1 |

(Continued)

OTHER PUBLICATIONS

PCT International Search Report and Written Opinion dated Feb. 9, 2018; PCT/US17/57615 filed Oct. 20, 2017.

*Primary Examiner* — Ghassem Alie

(74) *Attorney, Agent, or Firm* — Hartman Global IP Law; Gary M. Hartman; Domenica N. S. Hartman

(57) ABSTRACT

Size-reduction machines, feed units, and methods capable of producing reduced-size products from a variety of solid and semisolid materials. Such machines have an impeller that rotates on an approximately horizontal axis and an opening at an axial end of the impeller. A feed unit includes a feed hopper for feeding products to an interior of the impeller through the opening of the machine, and a slicing knife is mounted to the impeller and radially protrudes across the opening of the machine to slice products into segments as they enter the interior of the impeller.

14 Claims, 4 Drawing Sheets

(52) U.S. Cl.
CPC ..... *B26D 7/0683* (2013.01); *B26D 7/0691* (2013.01); *B26D 7/2614* (2013.01); *B26D 2210/02* (2013.01)

(58) Field of Classification Search
USPC ..... 99/544, 575, 574, 587; 426/478, 482, 426/479, 481, 95, 96, 97, 426, 91, 594, 426/595; 241/89.4, 95, 101.1, 428, 426.1, 241/30, 86.1, 89.3
See application file for complete search history.

(56) References Cited

U.S. PATENT DOCUMENTS

| | | | | |
|---|---|---|---|---|
| 4,186,543 | A * | 2/1980 | Lyell | B26D 1/08 241/100 |
| 4,873,105 | A | 10/1989 | Coppolani | |
| 5,129,299 | A | 7/1992 | Fischer et al. | |
| 5,394,793 | A * | 3/1995 | Julian | B26D 3/11 83/402 |
| 6,314,849 | B1 | 11/2001 | Arrasmith | |
| 6,561,067 | B2 | 5/2003 | Arrasmith | |
| 6,883,411 | B2 | 4/2005 | Arrasmith et al. | |
| 7,493,841 | B1 * | 2/2009 | Kaplan | B26D 1/147 241/262 |
| 9,352,479 | B2 * | 5/2016 | Walker | B26D 1/0006 |
| 2007/0227325 | A1 | 10/2007 | Urschel et al. | |
| 2013/0087032 | A1 * | 4/2013 | Walker | B26D 1/28 83/402 |
| 2014/0109737 | A1 | 4/2014 | Klockow et al. | |
| 2016/0075047 | A1 | 3/2016 | Fam | |
| 2016/0207213 | A1 | 7/2016 | Martin et al. | |
| 2016/0318201 | A1 * | 11/2016 | Underwood | B26D 7/0691 |

* cited by examiner

SIZE-REDUCTION MACHINES, FEED UNITS THEREFOR, AND METHODS OF USE

CROSS REFERENCE TO RELATED APPLICATIONS

This application claims the benefit of U.S. Provisional Application No. 62/411,037, filed Oct. 21, 2016, the contents of which are incorporated herein by reference.

BACKGROUND OF THE INVENTION

The present invention generally relates to methods and machines for cutting solid and semisolid materials, including food products.

The Affinity® dicer is a size-reduction machine manufactured by Urschel Laboratories, Inc., and is particularly well suited for dicing various materials, notable but nonlimiting examples of which include cheeses and meats. The Affinity® dicer is well known as capable of high capacity output and precision cuts. In addition, the Affinity® dicer has a sanitary design to deter bacterial growth.

A nonlimiting representation of an Affinity® size-reduction machine 10 is shown in FIG. 1. Product is delivered to the machine 10, for example, through a feed hopper (not shown), and enters a rotating impeller 12 through an axial opening 15 of the impeller 12. Within the impeller 12, centrifugal forces hold the product against an inner wall of a stationary case 14 equipped with a slicing knife 16. The slicing knife 16 is typically oriented approximately parallel to the generally horizontal rotational axis of the impeller 12, and is disposed in or adjacent an opening in the case 14 that defines an outlet of the impeller 12. Paddles 18 of the impeller 12 carry the product to the slicing knife 16, producing slices that enter a dicing unit of the machine. As used herein, the dicing unit comprises a part of the machine downstream of the knife 16 and generally includes a feed drum 20, feed roll 22, circular cutter 24, and cross-cutter 26, each of which individually rotates about its respective axis of rotation.

FIG. 2 represents an exploded view of the dicing unit of FIG. 1. Within the dicing unit, slices pass between the rotating feed drum 20 and feed roll 22, then enter the rotating circular cutter 24 whose axis of rotation is approximately parallel to the rotational axes of the impeller 12, rotating feed drum 20, and feed roll 22. The circular cutter 24 is equipped with disk-shaped knives (FIG. 2), each oriented approximately perpendicular to the rotational axis of the circular cutter 24 and, therefore, such that the knives cut each slice into multiple parallel strips. The strips pass directly into the rotating cross-cutter 26 whose axis of rotation is also approximately parallel to the rotational axis of the circular cutter 24. The cross-cutter 26 is equipped with rectilinear knives (FIG. 2), each oriented approximately parallel to the rotational axes of the cross-cutter 26, and therefore transverse and preferably perpendicular to the disk-shaped knives of the circular cutter 24, to produce final cross-cuts that yield a diced product. The rotational speed of the cross-cutter 26 is preferably independently controllable relative to the feed drum 20, feed roll 22, and circular cutter 24 so that the size of the diced product can be selected and controlled. As evident from FIG. 1, the rotational axes of the impeller 12, feed drum 20, feed roll 22, circular cutter 24, and cross-cutter 26 are all approximately horizontal and parallel to each other.

As represented in FIG. 2, each of the feed drum 20, feed roll 22, circular cutter 24, and cross-cutter 26 is configured to be individually coaxially mounted on a separate shaft or spindle. In the nonlimiting representation of FIG. 2, the feed drum 20 and cross-cutter 26 are shown as being individually mounted on separate spindle shafts 28 and 30, and are secured thereto with a retaining washer 40 and nut 42, and the feed roll 22 and circular cutter 24 are shown as being individually mounted on separate spindle shafts 44 and secured thereto with bolts 45. The feed drum 20, feed roll 22, circular cutter 24, and cross-cutter 26 are all shown as being cantilevered from a support structure 50 of the machine, for example, an enclosure, frame and/or other structures interconnected with the stationary case 14 and including drive systems operable to rotate the impeller 12, feed drum 20, feed roll 22, circular cutter 24, and cross-cutter 26 at the desired rotational speeds thereof.

FIG. 2 further represents a shear or stripper plate 32 supported and secured with bolts 36 to a support bar 34, which is represented in FIG. 2 as being cantilevered from the support structure 50, similar to the feed drum 20, feed roll 22, circular cutter 24, and cross-cutter 26. The stripper plate 32 has an upper shear edge 47 adapted to strip products (strips) from the circular cutter 24 prior to being diced with the cross-cutter 26. Slots 46 are defined in the stripper plate 32 facing the circular cutter 24, and the knives of the circular cutter 24 are partially received in the slots 46. The slots 46 extend to the shear edge 47, such that individual edges of the shear edge 47 between adjacent slots 46 protrude between adjacent knives of the circular cutter 24 to remove strips from therebetween. A lower shear edge 48 of the stripper plate 32 is in close proximity to the knives of the cross-cutter 26 to ensure complete dicing of the strips delivered from the circular cutter 24 to the cross-cutter 26. The slots 46 also extend through the thickness of the plate 32 to the base of the plate 32, such that an opening (not visible) is defined at the lower extent of each slot 46. The width of each slot 46 is sufficient to accommodate the axial thickness of one knife of the circular cutter 24 received therein and provide a clearance therebetween. The slots 46 also define parallel walls that separate adjacent knives of the circular cutter 24 from each other.

While completely well suited for many food processing applications, including cheeses for which the Affinity® is widely used, there is an ongoing desire for greater productivity and versatility in machines of this type.

BRIEF DESCRIPTION OF THE INVENTION

The present invention provides size-reduction machines, feed units, and methods capable of producing reduced-size products from a variety of solid and semisolid materials.

According to one aspect of the invention, a feed unit fora size-reduction machine is provided. The machine has an impeller that rotates on an approximately horizontal axis and an opening at an axial end of the impeller. The feed unit includes a feed hopper for feeding products to an interior of the impeller through the opening of the machine, and a slicing knife that is mounted to the impeller and radially protrudes across the opening of the machine to slice products into segments as they enter the interior of the impeller.

According to another aspect of the invention, a dicing machine is provided that includes a feed unit of the type described above. Other aspects of the invention include methods of using feed units and size-reduction machines of the types described above. Such a method includes rotating the impeller and feeding a food product into the impeller with the feed hopper so that the slicing knife cuts the segments from the food product as the food product enters the interior of the impeller.

A technical effect of the invention is the ability to process elongate products of a wide range of lengths, feed the products in a lengthwise direction into a rotating impeller, and cut the products as they enter the impeller so that segments cut from the products have lengths that can be accommodated by the axial length of the interior of the impeller. The cutting of the products as they enter the impeller eliminates the need to cut the products to lengths that can be accommodated by the impeller prior to being placed in the feed hopper.

Other aspects and advantages of this invention will be better appreciated from the following detailed description.

DETAILED DESCRIPTION OF THE INVENTION

Figure 1:
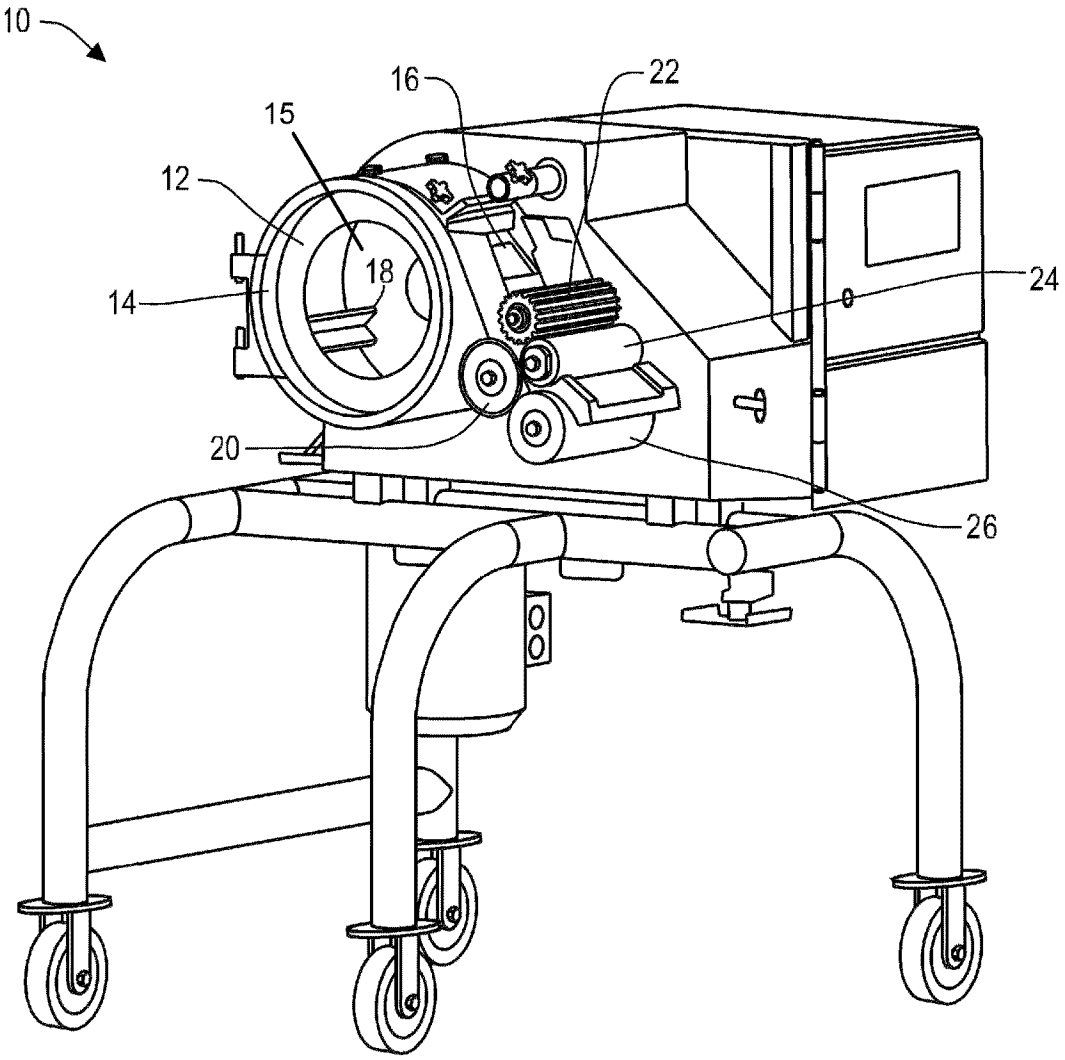
FIG. 1 (Prior Art)
FIG. 1 schematically represents an example of an Affinity® dicer machine.
Figure 2:
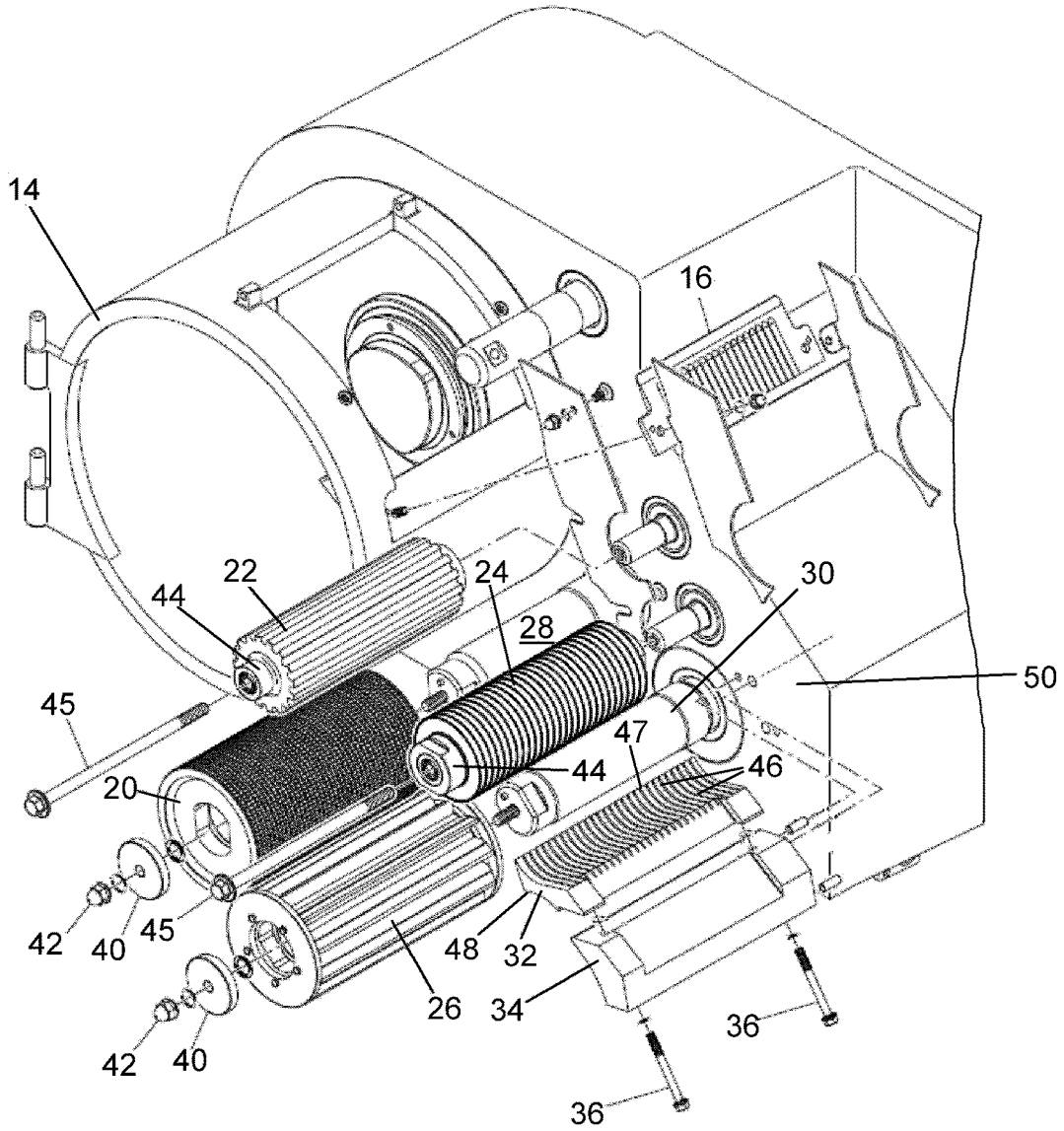
FIG. 2 (Prior Art)
FIG. 2 represents a fragmentary exploded view of a dicing unit of the Affinity® dicer machine of FIG. 1.
Figure 3:
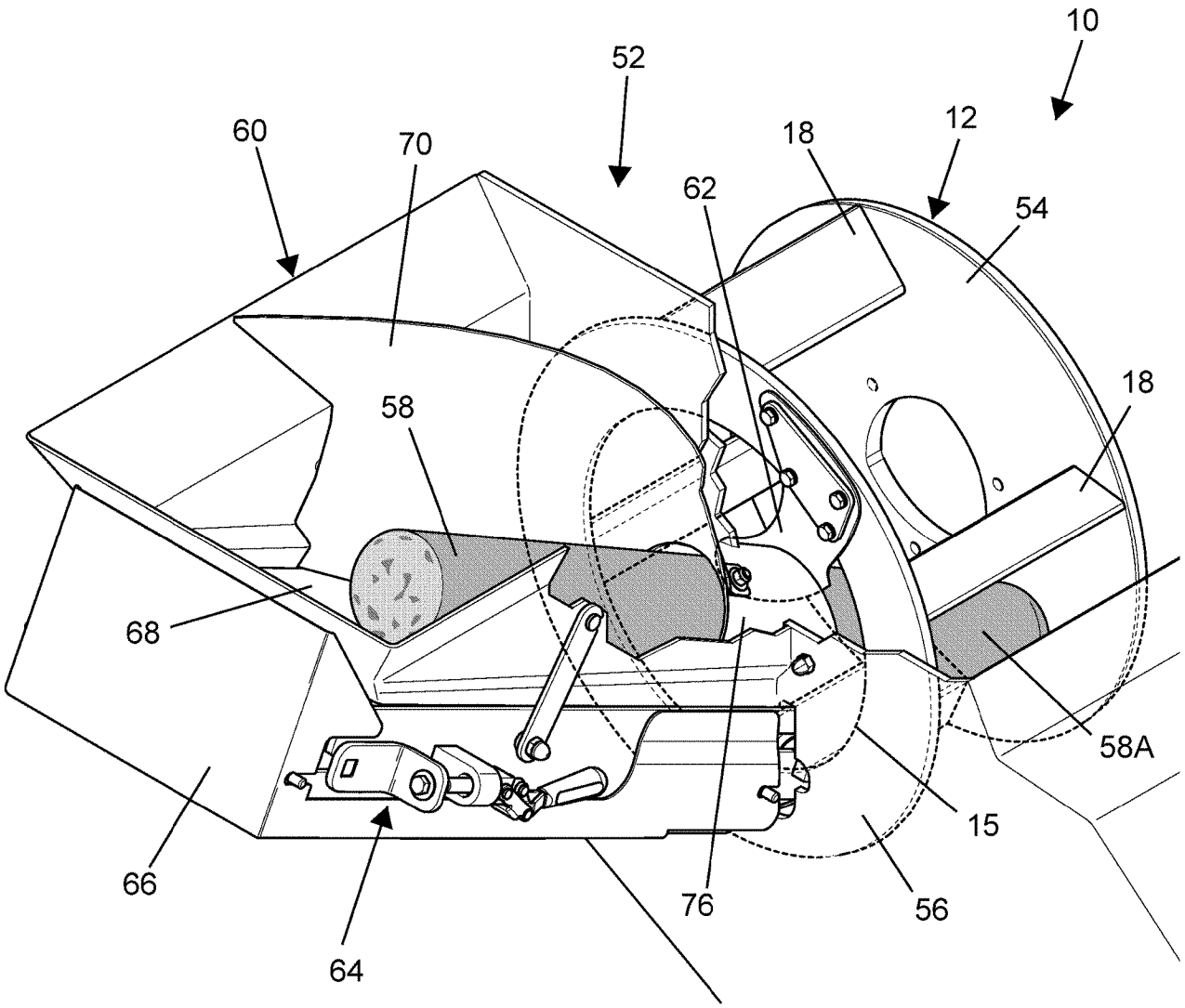
FIG. 3 is a perspective fragmentary view of a size-reduction machine of the type represented in FIGS. 1 and 2, to which a feed unit is mounted in accordance with a nonlimiting embodiment of the invention.
Figure 4:
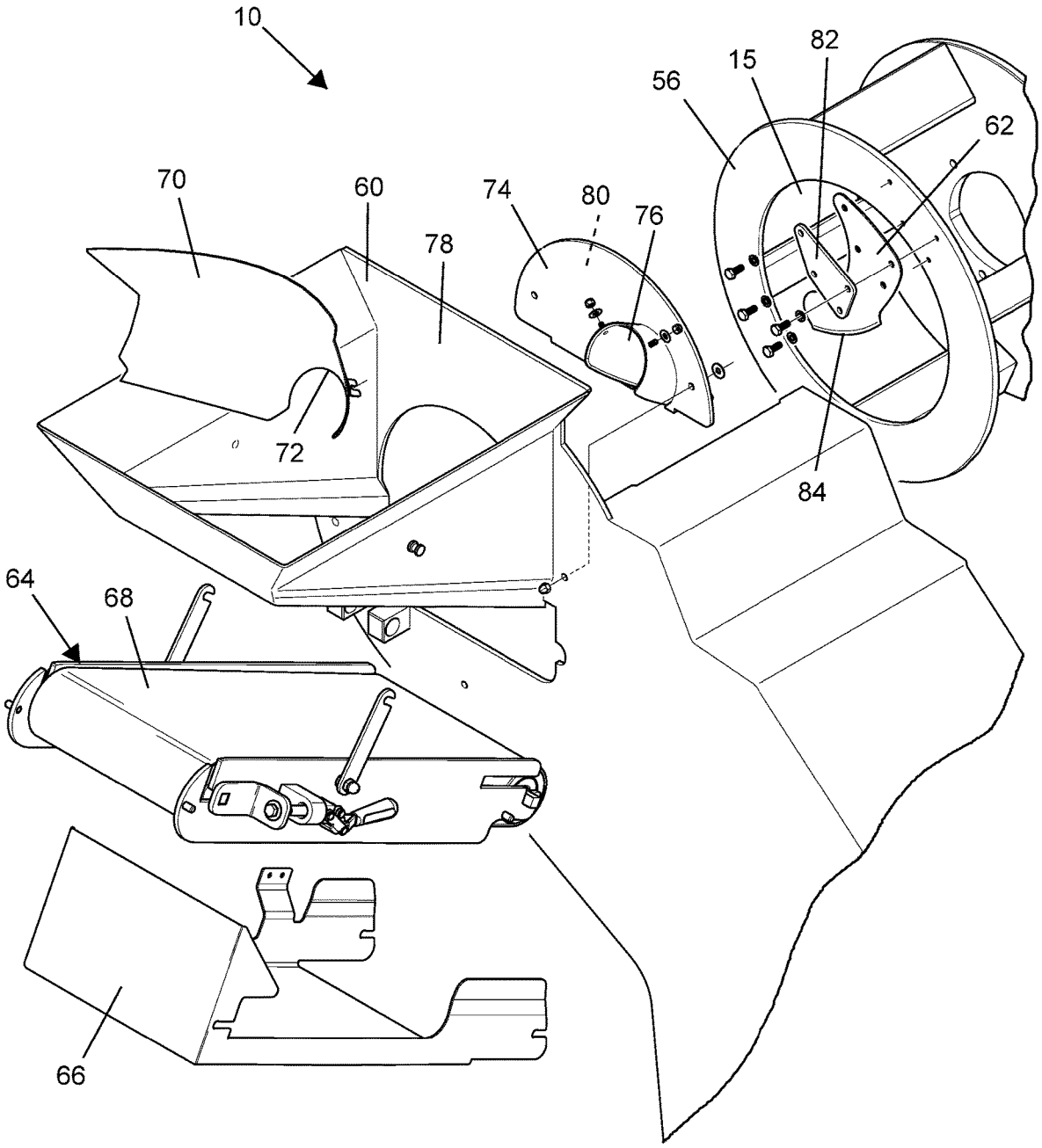
FIG. 4 is an exploded view of the feed unit of FIG. 3.

FIGS. 3 through 4 depict assembly and exploded views, respectively, of a feed unit 52 configured to be installed on a size-reduction machine, as a nonlimiting example, the Affinity® dicer represented in FIGS. 1 and 2. In some instances, the feed unit 52 may be a modification or retrofit of such a machine. As such, the following discussion will focus primarily on aspects of the feed unit 52 in reference to its installation on the size-reduction machine 10 of FIGS. 1 and 2, and consistent reference numbers are used in FIGS. 3 and 4 to identify components that are the same or functionally equivalent to components identified in FIGS. 1 and 2. Other aspects not discussed in any detail may be, in terms of structure, function, materials, etc., essentially as was described for FIGS. 1 and 2. Although the invention will be described hereinafter in reference to the machine 10 shown in FIGS. 1 and 2, it will be appreciated that the teachings of the invention are more generally applicable to other types of size-reduction machines, including but not limited to other size-reduction machines manufactured by Urschel Laboratories, Inc., for example, the INTEGRA® and DCA™ models.

The feed unit 52 includes a feed hopper 60 and a slicing knife 62 adapted to deliver elongate product to the rotating impeller 12 of the machine 10, after which the products may be processed in a manner similar to that described in reference to FIGS. 1 and 2. On the basis of the coaxial arrangement of the case 14 about the rotational axis of the impeller 12 as shown in FIG. 1, relative terms including but not limited to "axial," "circumferential," "radial," etc., and related forms thereof may be used below to describe the nonlimiting embodiment represented in the drawings, and such relative terms are intended to indicate the construction and orientations of components and features of the machine 10 relative to the rotational axis of its impeller 12. The case 14 is omitted in FIGS. 3 and 4 to expose the impeller 12, which is represented in FIG. 3 as having an approximately horizontal rotational axis, though it is foreseeable that its rotational axis could be inclined relative to horizontal.

The paddles 18 of the impeller 12 are represented in FIGS. 3 and 4 as being mounted between two ring plates 54 and 56, one of which defines the axial opening 15 through which a product 58 is shown being individually delivered to the impeller 12. The feed unit 52 is represented as being mounted at the opening 15, and preferably supported and oriented at the opening 15 so that the product 58 can be individually fed end-first into the interior of the impeller 12. The hopper 60 is represented in FIGS. 3 and 4 as declining toward the impeller 12 so that movement of the product 58 toward the impeller 12 can be assisted in part by gravity. Alternatively or in addition, a conveyor unit 64 is assembled with the hopper 60 so that the product 58 can be positively delivered to the impeller 12 at a controlled linear speed. For safety reasons, the conveyor unit 64 is largely enclosed by a cover 66 so that the belt 68 of the conveyor unit 64 is exposed only within the interior of the hopper 60. Within the hopper interior, a wall 70 is provided that promotes the orientation and travel of the product 58 in a substantially vertical plane, even if the product 58 were to be somewhat randomly dropped into the hopper 60. The product 58 exits the hopper 60 through a lower arcuate opening 72 (FIG. 4) in the wall 70, through which the product 58 enters and passes through a passage 76 in a shear plate 74 attached to a wall 78 of the hopper 60 facing the impeller 12.

The shear plate 74 has what will be referred to as a shear surface 80 that faces the impeller 12. The shear surface 80 is preferably planar and is oriented and positioned so as to be parallel and in close proximity to the plate ring 56 that defines the axial opening 15 of the impeller 12. A bracket 82 secures the slicing knife 62 to the plate ring 56 of the impeller 12, and the knife 62 is mounted to radially protrude across a limited portion of the opening 15, such that the knife 62 does not extend entirely across the opening 15. The radially innermost extremity of the knife 62 terminates with an arcuate cutting edge 84 (FIG. 4). Because the impeller 12 rotates, the knife 62 travels along a circular path with the impeller 12 and with each rotation of the impeller 12 cyclically passes across the opening of the passage 76 at the shear surface 80 of the shear plate 74. In the embodiment shown, the impeller 12 rotates in a clockwise direction, such that the knife 62 is traveling downward as it passes across the opening of the passage 76 at the shear surface 80. From FIG. 3, it should be evident that this downward direction of travel results in the knife 62 engaging the food product 58 in a downward direction to positively maintain the product 58 in contact with the belt 68 as the knife 62 passes through the product 58. FIG. 3 depicts the knife 62 in the process of slicing the product 58, so that a segment 58A cut from the product 58 drops into the interior of the rotating impeller 12.

From the above, it should be appreciated that the feed unit 52 provides the ability to process elongate products 58 of a wide range of lengths, feed the products 58 in a lengthwise direction into the rotating impeller 12, and cut the products 58 as they enter the impeller 12 so that the segments 58A cut from the products 58 consistently have lengths that can be accommodated by the axial length of the interior of the impeller 12. The length of the product 58 sliced with each rotation of the impeller 12 can be accurately controlled by synchronizing the linear velocity of the belt 68 with the rotational velocity of the impeller 12, for example, with a belt drive or digital controller, so that the length of each segment 58A cut from the product 58 does not exceed the axial length of the interior of the impeller 12. Once within the impeller 12, the segments 58A are further processed, for example, diced, by the dicing unit located in or adjacent the opening in the case 14 that defines an outlet of the impeller 12, as described in reference to FIGS. 1 and 2.

A wide variety of solid and semisolid materials can be processed with a size-reduction machine equipped with feed units 52 as described above, including but not limited to food products such as salami and sausages. While FIG. 3 shows a single product 58 being fed at one time to the impeller 12, multiple products could be fed simultaneously and side by side through the hopper 60. Modifications may be made to the hopper 60, knife 62, wall 70, and shear plate 74 for this purpose. Though an arcuate cutting edge 84 for the knife 62 is shown and believed to be preferred, other contours for the cutting edge 84 are foreseeable.

While the invention has been described in terms of a specific or particular embodiment, it is apparent that alternatives could be adopted by one skilled in the art. For example, the size-reduction machine, dicing unit, feed unit 52, etc., and their components could differ in appearance and construction from the embodiments described herein and shown in the drawings, functions of certain components of the machine and feed unit 52 could be performed by components of different construction but capable of a similar (though not necessarily equivalent) function, and various materials could be used in the fabrication of the machine, feed unit 52, and their components. In addition, the invention encompasses additional or alternative embodiments in which one or more features or aspects of the disclosed embodiment may be eliminated. Accordingly, it should be understood that the invention is not necessarily limited to any embodiment described herein or illustrated in the drawings. It should also be understood that the phraseology and terminology employed above are for the purpose of describing the illustrated embodiment, and do not necessarily serve as limitations to the scope of the invention. Therefore, the scope of the invention is to be limited only by the following claims.

The invention claimed is:

1. A feed unit for a size-reduction machine, the machine having an impeller that rotates on an approximately horizontal axis and an opening at an axial end of the impeller, the feed unit comprising:

a feed hopper for feeding products to an interior of the impeller through the opening of the machine;

a shear plate between the feed hopper and the impeller, the shear plate having a passage therein that defines a passage opening in the shear plate through which the products enter the interior of the impeller from the feed hopper, the passage opening being smaller than the opening of the machine and offset from the horizontal axis of the impeller; and a slicing knife that is mounted to a plate ring of the impeller that surrounds the opening of the machine, the slicing knife being cantilevered from the plate ring and radially protrudes inward from the plate ring across a limited portion of the opening of the machine so that the slicing knife travels along a circular path and cyclically passes across the passage opening in the shear plate with each rotation of the impeller, the slicing knife having a cutting edge that slices segments from each product as the product enters the interior of the impeller through the passage.

2. The feed unit according to claim 1, wherein the feed hopper is supported and oriented at the opening of the machine to feed each product end-first into the interior of the impeller.

3. The feed unit according to claim 1, wherein the feed hopper is configured to individually feed the products to the interior of the impeller through the passage opening in the shear plate so that the slicing knife slices the segments from a single product as the product enters the interior of the impeller.

4. The feed unit according to claim 1, wherein the shear plate has a shear surface facing the impeller, the shear surface being planar and oriented and positioned so as to be parallel and in close proximity to the opening of the machine.

5. The feed unit according to claim 1, wherein the slicing knife has a radially innermost extremity that terminates at the cutting edge.

6. The feed unit according to claim 1, wherein the cutting edge is an arcuate cutting edge.

7. The feed unit according to claim 1, wherein the slicing knife does not extend entirely across the opening of the machine.

8. The feed unit according to claim 1, further comprising a conveyor belt for conveying the products through the feed hopper to the impeller.

9. The feed unit according to claim 8, further comprising means for synchronizing a linear velocity of the conveyor belt with a rotational velocity of the impeller so that the length of each of the segments cut from each product does not exceed an axial length of the interior of the impeller.

10. The feed unit according to claim 8, wherein the slicing knife is mounted to travel along a circular path with each rotation of the impeller so as to engage the products in a downward direction to positively maintain the products in contact with the conveyor belt as the slicing knife passes through the products.

11. A method of using the machine of claim 1, the method comprising rotating the impeller and feeding the products into the impeller with the feed hopper so that the slicing knife cuts the segments from the food products as the food products enter the interior of the impeller.

12. A size-reduction machine comprising:

an impeller that rotates on an approximately horizontal axis;

an opening at an axial end of the impeller;

a feed unit comprising a feed hopper for feeding products to an interior of the impeller;

a shear plate between the feed hopper and the impeller, the shear plate having a passage therein that defines a passage opening in the shear plate through which the products enter the interior of the impeller from the feed hopper, the passage opening being smaller than the opening of the machine and offset from the horizontal axis of the impeller; and a slicing knife that is mounted to a plate ring of the impeller that surrounds the opening of the machine, the slicing knife being cantilevered from the plate ring and radially protrudes inward from the plate ring across a limited portion of the opening of the machine so that the slicing knife travels along a circular path and cyclically passes across the passage opening in the shear plate with each rotation of the impeller, the slicing knife having a cutting edge that slices segments from each product as the product enters the interior of the impeller through the passage.

13. The size-reduction machine according to claim 12, wherein the feed hopper is configured to individually feed the products end-first to the interior of the impeller through the passage opening in the shear plate so that the slicing knife slices the segments from a single product as the product enters the interior of the impeller.

14. The size-reduction machine according to claim 12, wherein the machine is a dicing machine that comprises a dicing unit at an outlet of the impeller.

* * * * *